United States Patent [19]

Cvetan

[11] 4,120,125

[45] Oct. 17, 1978

[54] POST SUPPORT

[76] Inventor: Joseph Cvetan, 11549 S. Kedvale, Alsip, Ill. 60658

[21] Appl. No.: 850,081

[22] Filed: Nov. 10, 1977

[51] Int. Cl.[2] ..... E02D 5/74

[52] U.S. Cl. ..... 52/156; 52/165; 52/297; 52/298

[58] Field of Search ..... 52/155, 156, 165, 296–298, 52/166

[56] References Cited

U.S. PATENT DOCUMENTS

| | | | |
|---|---|---|---|
| 165,557 | 7/1875 | Geer | 52/155 |
| 383,296 | 5/1888 | Husselman | 52/165 |
| 1,875,137 | 8/1932 | Pollock | 52/165 |

FOREIGN PATENT DOCUMENTS

| | | | |
|---|---|---|---|
| 174,425 | 2/1961 | Sweden | 52/156 |

*Primary Examiner*—James L. Ridgill, Jr.

[57] ABSTRACT

A post supporter includes a socket having an elongated spike-like extension on its bottom which is intended to be forced in the ground until the bottom of the socket rests on the ground surface. A stabilizing assembly consisting of a generally vertically extending portion and a horizontally extending portion project from the spike to prevent rotation of the supporter and to prevent it from tilting.

4 Claims, 6 Drawing Figures

POST SUPPORT

BACKGROUND OF THE INVENTION

This invention relates to improvements in post supporting apparatus.

Apparatus for supporting posts in the ground, of course, have been known for some time. Obviously one ancient way of doing this is to dig a hole in the ground and place the post in the hole. However, various proposals have been made to support posts or post-like elements using sockets anchored in the ground in some fashion.

Such devices are shown, for instance, in U.S. Pat. Nos. 3,318,560 and 3,441,239. U.S. Pat. No. 3,318,560 discloses a mast supporting assembly which includes a retractable auger which is rotated to sink the auger into the ground and a tubular mast is then mounted in the base formerly occupied by the auger. U.S. Pat. No. 3,441,239 discloses a rod holder with a spike 12 on its bottom and a pair of clamps to hold a rod after the holder has been driven into the ground.

Other patents which show spikes or spike-like devices extending from sockets to provide post or mast supports are U.S. Pat. Nos. 1,577,612, 2,414,358 and 2,441,109. In addition it has also been proposed to provide various kinds of stabilizers in connection with post supporting means. Such stabilizers are shown in U.S. Pat. Nos. 2,877,828 and 3,342,444.

A particular situation where it is desirable to quickly provide a means for supporting a post is in connection with the sale of real estate where signs are very frequently provided on the lawns of property being offered for sale. It has been found to be a great inconvenience to the property owner, and certainly disturbing to the appearance of the lawn, when a hole is dug and a sign post mounted in the hole. To eliminate these problems and to permit a post used for such purposes to be quickly supported on and removed from a lawn when it has served its purposes this invention is provided.

It is an object of this invention to provide a novel post support which may be quickly and easily mounted in the ground or removed therefrom.

It is another object of this invention to provide a novel post support which when mounted provides a stable structure capable of supporting a post of substantial size and weight.

It is a further object of this invention to provide a novel post support which is relatively stable when in use.

BRIEF SUMMARY OF THE INVENTION

The invention comprises a socket capable of receiving the end of a post to be supported, which socket is provided with a spike-like extension extending from its bottom. Vertical and horizontal stabilizing means extend from the spike and the arrangement is such that the spike may be quickly driven into the ground along with the stabilizing means and the post to be supported placed in the socket.

BRIEF DESCRIPTION OF THE DRAWING

The invention itself is set forth with particularity in the claims appended hereto and forming a part of this specification, while an understanding of the construction and use of an embodiment thereof may be had by reference to the detailed description taken in conjunction with the drawing in which:

DETAILED DESCRIPTION

Figure 1:
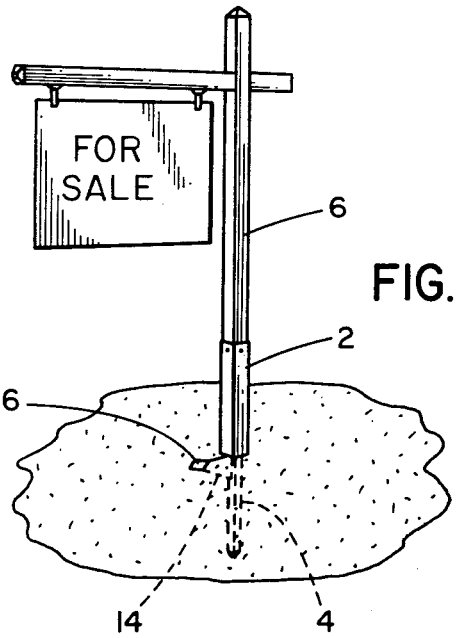
FIG. 1 is an illustration of an embodiment of the invention in use.
Figure 2:
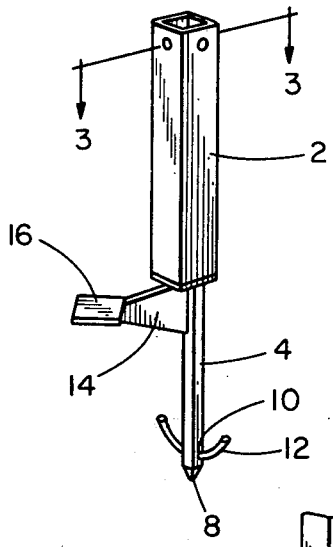
FIG. 2 is a perspective illustration of the same embodiment of the invention.
Figure 3:
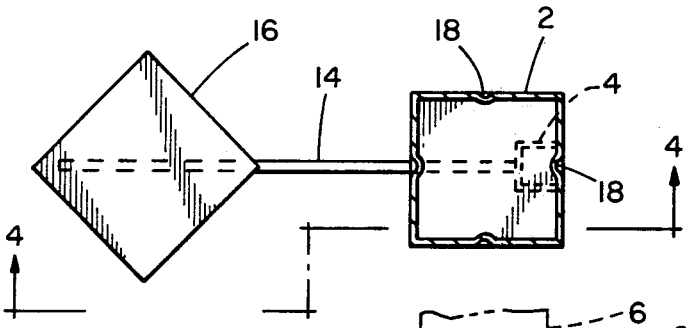
FIG. 3 is a view along the line 3—3 of FIG. 2.
Figure 4:
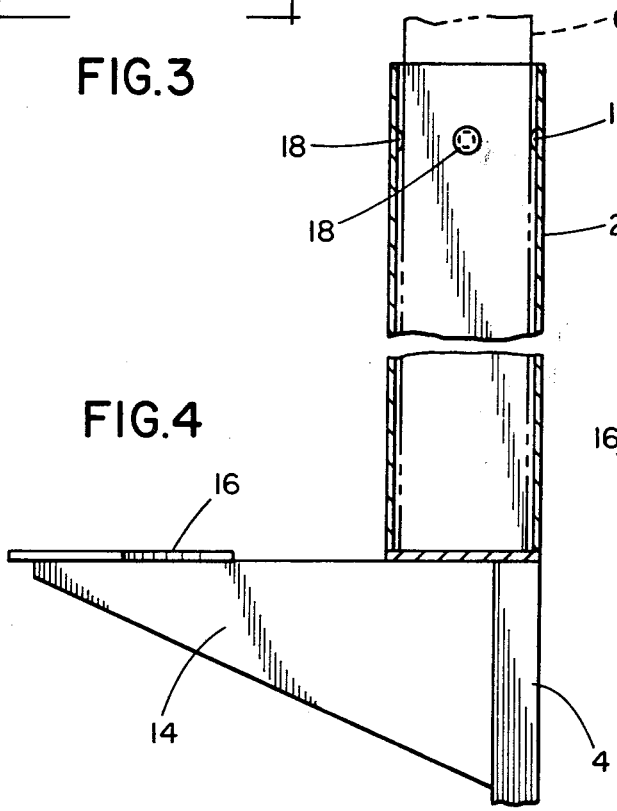
FIG. 4 is a view along the line 4—4 of FIG. 3.
Figure 5:
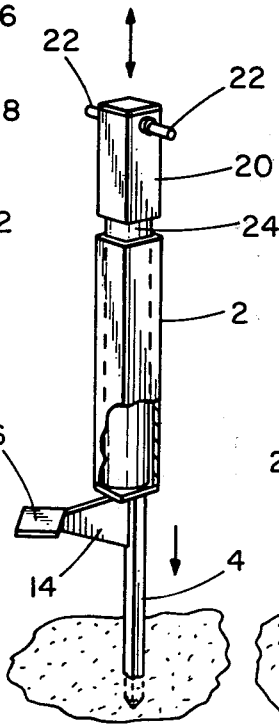
FIG. 5 is an illustration of means for driving a post support in accordance with the invention into the ground.
Figure 6:
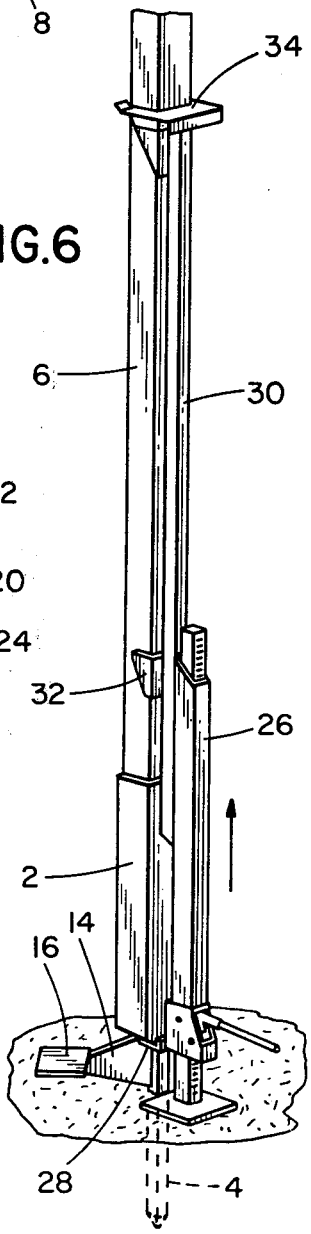
FIG. 6 is an illustration of means cooperating with a post support in accordance with the invention to remove it from the ground after it has served its purpose.

In accordance with the invention, the post support comprises a socket 2 having a spike-like member 4 extending from its bottom. In the embodiment illustrated the socket is formed as a rectangular member to receive the bottm of a rectangular post 6 comprising a supporting post for a sign used for advertising purposes as, for instance, a sign indicating that a house or other piece of property is for sale. Obviously if it were desired to form the socket 2 and member 4 so as to have a circular or some other cross section, this would merely be a designer's choice.

The member 4 is provided with a pointed end 8 to facilitate its entry into and penetration through the ground. If desired a hole 10 can extend through the member 4 and receive a bar or a piece of rod 12 bent upwardly to form a hook or anchor in order to prevent the easy removal of the post support by unauthorized persons such as vandals.

Extending outwardly from the member 4 at its upper end is a vertical stabilizer 14 formed as a triangular stabilizing element or gusset which has attached thereto a flat horizontal plate 16 to provide a horizontal stabilizer. Provided in the side walls of the socket 2 are detents or depressions 18 to engage the sides of the post 6 to more securely hold it in the socket.

When it is desired to mount a post using a support in accordance with the invention, a driving tool or knocking device 20 may be used and operated by the handles 22. The knocking device may be roughly the same shape as the socket and provided with an extension 24 extending part way into the socket. The driving device 20 may be lifted up and driven down in the manner of a hammer until the spike-like member 4 and vertical stabilizing member 14 are driven completely into the ground as shown in FIG. 1. When this is done the bottom of the socket 2 will be in contact with the upper surface of the ground as will the horizontal stabilizing member 16. When this is done the vertical stabilizing member 14 will prevent rotation of the socket and spike so that the post and sign mounted therein will maintain its desired orientation. At the same time the horizontal stabilizing member resting on the upper surface of the ground will prevent the socket from tilting.

In order to remove the post and socket a ratchet jack 26 may be used and provided with a bottom flange 28 engaging underneath the socket and a lifting bar 30 gripping the sides of the post at 32 and 34. When the jack is operated the support with the post mounted therein will be withdrawn from the ground, and when the post is removed from the socket the support may then be used in some other location.

Various changes may be made by a designer in connection with various parts of the invention, and it is intended by the claims appended hereto to cover all such changes as come within their scope.

What is claimed as new and desired to be secured by Letters Patent is:

1. A support comprising an elongated socket having a height sufficient to extend a substantial distance along the height of a post to be supported therein whereby a post may be supported solely by the support, an elongated spike-like member extending from the bottom of the socket for mounting in a supporting surface, a vertical stabilizing member extending outwardly from the upper end of said pointed member and a horizontally extending flat plate attached only to the free end of the said vertical stabilizing member whereby a post received in said socket will be entirely self-supported thereby.

2. A post support as set forth in claim 1 wherein said vertical stabilizing member comprises a generally triangularly shaped element, and wherein one of the sides of said element is generally perpendicular to the longitudinal axis of said pointed member.

3. A post support as set forth in claim 2, including means at the bottom of said member for anchoring said post support in the ground.

4. A post support as set forth in claim 3, including inwardly directed detents in said socket for holding a post therein.

* * * * *